US005182137A

United States Patent [19]

Allen

[11] Patent Number: 5,182,137

[45] Date of Patent: Jan. 26, 1993

[54] METHOD OF APPLYING A BOUND PARTICULATE RUBBER OUTDOOR SURFACE

[75] Inventor: Harold O. Allen, Fort Scott, Kans.

[73] Assignee: 501 Amlite Corporation, Fort Scott, Kans.

[21] Appl. No.: 652,949

[22] Filed: Feb. 8, 1991

[51] Int. Cl.[5] ..... E01C 5/12

[52] U.S. Cl. ..... 427/138; 404/31; 404/32; 404/82; 427/139; 427/202; 427/203; 428/147; 428/327

[58] Field of Search ..... 428/145, 147, 219, 143, 428/323, 327, 489, 172, 173; 404/72, 73, 32, 17, 75, 81, 82; 427/136, 137, 138, 139, 202, 203; 156/279, 397

[56] References Cited

U.S. PATENT DOCUMENTS

| | | | |
|---|---|---|---|
| 1,760,690 | 5/1930 | Flood | 404/17 |
| 2,147,362 | 2/1939 | Bloomberg | 521/54 |
| 2,871,774 | 2/1959 | Johnson | 427/139 X |
| 2,925,831 | 2/1960 | Welty et al. | 427/139 X |
| 2,977,864 | 4/1961 | Pullar | 264/31 |
| 3,253,521 | 5/1966 | Endres | 404/73 |
| 3,333,517 | 8/1967 | Kohler | 404/79 |
| 3,446,122 | 5/1969 | Raichle et al. | 404/28 |
| 3,778,397 | 12/1973 | Gannon et al. | 523/307 |
| 3,891,585 | 6/1975 | McDonald | 106/187 |
| 3,993,412 | 11/1976 | Drane | 404/28 |
| 4,068,023 | 1/1978 | Nielsen et al. | 427/138 |
| 4,082,888 | 4/1978 | Portin | 428/327 |
| 4,341,836 | 6/1982 | Becker | 428/308.4 |
| 4,420,513 | 12/1983 | Coke | 427/407 |
| 4,474,833 | 10/1984 | Maxfield | 427/138 |
| 4,478,912 | 10/1984 | Uffner et al. | 428/349 |
| 4,529,622 | 7/1985 | Maxfield | 427/136 |
| 4,606,963 | 8/1986 | Farrell | 428/150 |

OTHER PUBLICATIONS 440 and 400 Running Tracks, Brochure by Laykold Corp. May 1984.

Page 6 of Laykold Corp. application specifications, Feb. 1981.

*Primary Examiner*—Paul J. Thibodeau

*Assistant Examiner*—Hoa T. Lê

*Attorney, Agent, or Firm*—Hovey, Williams, Timmons & Collins

[57] ABSTRACT

A method of applying a bound particulate rubber outdoor surface comprises the initial step of providing a prepared base onto which the surface is to be applied. A primer layer is applied to the base, and is composed of a mixture including water such that the layer is wet when applied and dries as the water in the mixture evaporates. A fluidized stream of particulate rubber is directed onto the primer layer before the primer layer dries so that a layer of particulate rubber is formed on top of the primer layer and settles at least partially in the primer layer. Thereafter, the primer layer is allowed to dry before application of a binder layer over the particulate rubber. The binder layer also is composed of a mixture including water. A fluidized stream of particulate rubber is then directed onto the wet binder layer so that a layer of particulate rubber is formed ont op of and settles in the binder layer. An additional binder layer is applied over the layer of particlate rubber after the binder layer immediately beneath the layer of particulate rubber dries, and these last two steps are repeated until a surface of desired thickness is formed. A latex-bound, particulate rubber outdoor surface is also disclosed which includes alternate layers of binder and particulate rubber, wherein each layer of particulate rubber is at least partially embedded in the binder layer immediately therebelow as well as in the overlaying binder layer.

7 Claims, 1 Drawing Sheet

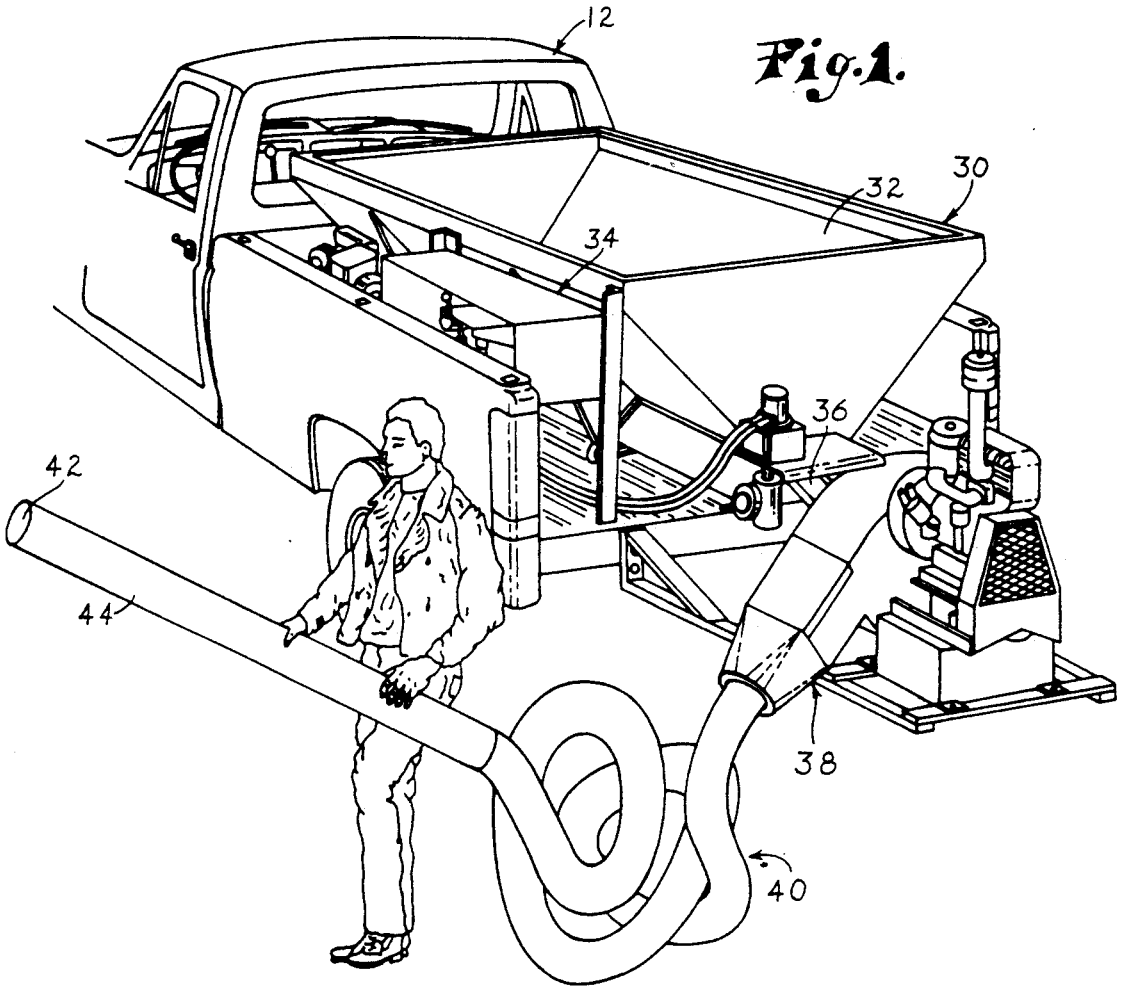
Fig. 1.
Fig. 2.
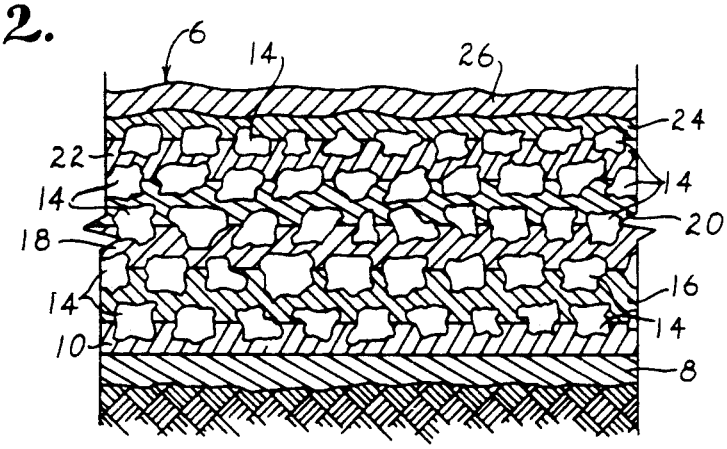

METHOD OF APPLYING A BOUND PARTICULATE RUBBER OUTDOOR SURFACE

BACKGROUND OF THE INVENTION

1. Field of the Invention

The present invention relates generally to surfaces for outdoor use and, more particularly, to a bound particulate rubber outdoor surface for use as an athletic playing or track surface.

2. Discussion of the Prior Art

It is known from U.S. Pat. No. 4,082,888 to Portin, to provide a cushioned protective outdoor surface formed of a composition including vulcanized rubber particles and a latex solution. In providing such a surface, the composition is mixed with water and a wetting solution and is applied wet to the underlying existing base surface in a single application such that the complete thickness of the surface is defined by the single layer of composition. According to this known method, once the protective surface layer is applied in the desired thickness, it is allowed to dry and take its final form.

Another known method for constructing an outdoor surface replaces the single layer application approach with a multi-layer approach, wherein a number of coating layers are sequentially laid down on top of a foundation surface and uniform layers of particulate rubber are applied to each coating layer after the underlying coating layer has dried and before application of the next succeeding layer.

Numerous drawbacks exist in the conventional methods. For example, where the single-layer surface application method is used in preparing an outdoor athletic track surface, it is common for the surface to be banked inward, and upon application of the single layer of composition, settling tends to occur due to the thickness and consistency of the composition. In addition to the problems accompanying settling per se, such an occurrence magnifies a further problem in the known methods wherein bubbling of the surface occurs due to the curing of the composition. This bubbling has been found to be most severe in regions where the composition is the thickest.

This problem of settling is also present in the multi-layer surface application methods, wherein each layer of coating material is applied to an underlying layer and then permitted to dry prior to application of the succeeding particulate rubber layer. Absent the particulate rubber, the wet coating layer flows more freely toward low spots in the underlying surface permitting thick regions to form in the layer and thus increasing the tendency for bubbling to occur.

The present inventor has previously employed a multi-layer surface application method differing from the afore-mentioned methods in that particulate rubber is applied over previously applied coating layers while the coating material is still wet. This method includes manually throwing particulate rubber onto the surface with shovels shortly after the underlying layer is applied so that the particulate rubber sinks into the coating material before the material dries.

Although this known method protects against settling of the coating layer, the method possesses certain drawbacks. For example, because the particulate rubber is manually applied, the method is labor intensive, requiring several workers to distribute the rubber.

Further, it is difficult to uniformly distribute the particulate rubber on the underlying layer because of the distances to which the particles must be thrown. Because it is not possible to walk on the wet underlying coating layer, reliance is placed on the skill of the workers throwing the particles onto the surface to insure that a uniform layer of rubber is applied.

OBJECTS AND SUMMARY OF THE PRESENT INVENTION

It is an object of the present invention to provide a method of applying a latex-bound particulate rubber outdoor surface which overcomes the shortcomings in the conventional methods and which results in an outdoor surface having improved cushioning characteristics and a prolonged useful life.

It is another object of the invention to provide such a method, wherein buildup of the surface to a desired thickness may be carefully controlled, and the effects of settling of any given layer are reduced. Also, an object of the invention resides in impeding undesired movement of binder material during application of the surface so as to reduce the opportunity for bubbling to occur.

In accordance with these and other objects, a method of applying a latex-bound particulate rubber outdoor surface includes the initial step of applying a primer layer to a previously prepared base, the primer layer being composed of a primer mixture including water such that the layer is wet when applied and dries as the water in the mixture evaporates. After application of the primer layer, a stream of dry particulate rubber is directed onto the primer layer before the primer layer dries so that a layer of particulate rubber is formed on top of the primer layer and settles at least partially in the primer layer. A binder layer is applied over the particulate rubber after the primer layer dries, and is composed of a first binder mixture including water such that the layer is wet when applied and dries a the water in the mixture evaporates. Before the binder layer dries, a stream of particulate rubber is directed onto the binder layer so that a layer of particulate rubber is formed on top of the primer layer and settles at least partially therein. An additional binder layer is applied over the layer of particulate rubber after the binder layer immediately beneath the layer of particulate rubber dries, and these final two steps are repeated until the surface is built-up to a desired thickness.

The particulate rubber is applied by a broadcasting apparatus that moves the particles in a stream such that fluid-like motion of the particles is carried out. This fluidized stream is then directed over the surface by an operator.

By this construction, numerous advantages are realized. For example, by broadcasting particulate rubber onto the primer layer and each binder layer while still wet, the rubber is more fully encapsulated within the completed surface than in known constructions. This reduces the opportunity for foreign substances to infiltrate the surface and thus increases the useful life of the surface. Further, because the particulate rubber is applied to each underlying layer while wet, the rubber tends to impede movement of the underlying layer toward the low side of the base surface thus permitting a more uniform application to be carried out.

BRIEF DESCRIPTION OF THE DRAWING FIGURE

A preferred embodiment of the present invention is described in detail below with reference to the attached drawing figures, wherein:

FIG. 1 is a perspective view of an apparatus for storing particulate rubber and for mechanically pumping the particulate rubber from the storage location and broadcasting the rubber onto a substrate; and FIG. 2 is a side sectional view of a bound particulate rubber outdoor surface constructed in accordance with the present invention.

DETAILED DESCRIPTION OF THE PREFERRED EMBODIMENT

A preferred embodiment of the inventive method of applying a bound particulate rubber outdoor surface is discussed in detail with reference to the outdoor track surface 6 shown in FIG. 2.

When such an outdoor surface is to be applied, e.g. to an athletic track or the like, it is necessary to first provide a prepared base 8. Preferably, this base is either asphalt or concrete, and may be newly formed or merely an existing underlying substrate.

In the initial step of the preferred method, a primer layer 10 is applied to the prepared base through the use of a conventional pump-spray system employing conventional equipment such as the Neal ESP-550 spray unit marketed by Neal Manufacturing Company, or any equivalent equipment. The primer layer is composed of a primer mixture including an asphalt emulsion and water. The preferred asphalt emulsion is SS1H, although other known emulsions may also be used, and is applied at a rate of about 0.2 gallons per square yard. This rate of application is achieved by applying the primer mixture at a rate of 0.4 gallons per square yard where the asphalt emulsion is combined with water in a one-to-one ratio in the primer mixture.

Preferably, the primer layer is put down within a region extending across the entire width of the track for a distance of approximately 30 yards in the direction of the length of the track in order to permit application of the next succeeding layer before the primer layer dries. This area of coverage may be increased or decreased dependent upon ambient conditions in order to insure proper application of the succeeding layers.

During or immediately after application of the primer layer within any given region of the track, while the primer layer is still wet, a vehicle 12 such as that shown in FIG. 1 is driven along the region. This vehicle 12 includes means for broadcasting particulate rubber 14 onto the primer layer 10 and such broadcasting of rubber is carried out while the primer mixture is wet so that the rubber particles settle in the primer mixture. As discussed more fully below, the means for broadcasting the particulate rubber includes an apparatus for storing particulate rubber and for mechanically pumping the particulate rubber from the storage location as a fluidized stream to a dispensing hose which is manually directed over the primer layer.

Preferably, the particulate rubber 14 includes stranded waste tire buffings obtained as a result of recapping old tires. Any desired size of such buffings may be used, although it is preferred to use medium-sized buffings. The sizing of such buffings is measured by employing a sieve analysis, and medium-sized buffings are considered to be those which have a 100% pass rate through a 6m screen, a 30% pass rate through a 12m screen, a 7% pass rate through a 16m screen, and a 3% pass rate through a 20m screen. By employing these medium-sized buffings, the particulate rubber may be applied in a layer of desired depth but will include enough voids and open space between the buffings to permit permeation of a succeeding binder layer into the particulate rubber so that total encapsulation of each buffing is permitted.

When the size of the rubber buffings is chosen too small, it becomes difficult to apply a layer of the particulate rubber onto the primer layer in a desired thickness without the upper particles of the particulate rubber layer shielding the lower particles therein from a succeeding binder layer, thus preventing permeation of the succeeding binding layer. On the other hand, if the buffings are too large, the voids or interstices formed by and between the buffings collect and trap water within the particulate rubber layer and prevent the water from evaporating during drying of the succeeding binder layer.

Although the desired rate of application of the particulate rubber is between about 1.5 and 2.0 pounds per square yard, because the particulate rubber is manually directed onto the primer layer it is possible for the person controlling application of the particulate rubber to vary the amount of particulate rubber applied to any given area within the region of coverage in order to accommodate any non-uniformities in the underlying layers. Thus, if a depression exists in the underlying prepared base, or if an insufficient amount of particulate rubber is broadcast over a certain area, the controller may simply redirect the fluidized stream of buffings over that area in order to build up a desired thickness. If the depression in the underlying base is severe, this buildup of buffing thickness may be achieved gradually over the course of application of the several layers discussed below. Alternately, if too much particulate rubber is broadcast onto an area of the region, it is possible to rake off excess rubber after the underlying primer layer has dried and prior to application of a succeeding binder layer.

Once the layer of particulate rubber has been applied over the entire region, the surface is allowed to dry while an adjacent region of the track is treated. The time required for this drying depends upon ambient conditions. Preferably, by driving the vehicle along the length of the track a distance of 20 to 30 yards behind the pump-spray system, it is possible to apply the primer layer 10 and the particulate rubber layer 14 over the entire track surface rather than in segregated sections. Such a step insures continuity of the layers along the track.

Once the primer layer 10 has dried, if desired, a second primer layer may be applied. Where a second primer layer is used, the previously discussed steps are repeated and a layer of particulate rubber is applied to the second primer layer while the second primer layer is still wet.

Once the desired number of primer layers have been applied and allowed to dry, a first binder layer 16 is applied. This binder layer is composed of a binder mixture including a latex binder, an asphalt emulsion and water. The asphalt emulsion used is preferably of the same type as that used in the primer layer. The latex binder is of a strength much greater than the asphalt emulsion and reduces bubbling while strengthening the mixture. The latex binder is preferably of the styrene butadiene rubber (SBR) type, such as a 4170 SBR marketed by UNOCAL, and is present in the binder mixture in an amount of 10%, with another 40% of the mixture being asphalt emulsion and 50% of the mixture being water. The preferred rate of application of the mixture is about 0.3 to 0.4 gallons per square yard.

Just as with application of the primer layer or layers 10, application of the binder layer 16 is followed closely by application of another particulate rubber layer 14. Thus, while the binder layer 16 is still wet, particulate rubber is broadcast onto the surface so that the buffings settle into the binder mixture. This step is best achieved, as before, by driving the vehicle along the track behind the pump-spray assembly at a distance of 20 to 30 yards.

Once the layer of particulate rubber is put down, the binder layer 16 is allowed to dry. Thereafter, a second binder layer 18 is applied in a manner similar to the first primer layer. This second binder layer 18 preferably is composed of a mixture including 25% latex binder, 25% asphalt emulsion, and 50% water. Preferably, the latex binder is of the type described above and includes an ultraviolet inhibitor which protects the surface from the harsh effects of solar radiation.

Again, application of the second binder layer 18 is followed by the step of applying particulate rubber 14 to the wet binder mixture. The layers of particulate rubber 14 are preferably applied at a consistent rate which remains unchanged from layer to layer, except where variations are desired to compensate for inconsistencies in underlying layers.

After the second binder layer 18 has dried, an additional binder layer 20 is applied, and the steps are repeated of directing a fluidized stream of particulate rubber 14 onto an underlying wet binder layer and of applying an additional binder layer over the particulate rubber upon drying of the binder layer immediately beneath the particulate rubber until the surface is built-up to a desired thickness.

Preferably, the first additional binder layer 20 is composed of a binder mixture similar to that used in the second binder layer. However, subsequent additional binder layers 22, 24 preferably are composed of a mixture including 50% latex binder and 50% water. These subsequent layers 22, 24 may include ultraviolet inhibitors as well as colorants. Further, a surfactant material such as a nonsudsing ammonia may be added to the binder layers 16, 18, 20, 22, 24 in order to improve penetration of the binder mixture in underlying layers.

Where it is desired to provide a surface having an overall thickness of about ⅜", the completed surface may include a single primer layer and five binder layers, with particulate rubber layers interposed between each, as shown in FIG. 2. However, it is also possible to form a surface of equivalent thickness with four binder layers of somewhat greater depth.

Once the final binder layer 24 has been applied, it is allowed to dry and a sheen layer 26 is laid down. The sheen layer is composed of a sheen mixture including 50% latex binder and 50% water, with the latex binder being provided with an ultraviolet inhibitor. A colorant may also be added to the sheen layer; however, no surfactant is added. Preferably, the sheen mixture is 25% 4170 SBR; 25% 1019 SBR; and 50% water, wherein 4170 SBR and 1019 SBR are latex binders available from UNOCAL. The rate of application of the sheen mixture to the underlying binder layer is about 0.1 gallons per square yard.

The resulting outdoor surface produced via the method described above is a latex-bound, particulate rubber surface comprising a primer layer 10, a first layer of particulate rubber 14 on top of the primer layer, the particulate rubber being at least partially embedded in the primer layer. A first binder layer 16 is provided on top of the first layer of particulate rubber and a second layer of particulate rubber 14 is disposed on top of the first binder layer with the particulate rubber being at least partially embedded in the first binder layer. A second binder layer 18 overlies the second layer of particulate rubber, and successive layers 14, 20, 14, 22, 14, 24 of particulate rubber and binder mixture are provided, with each additional binder layer being applied on top of the last applied layer of particulate rubber. Each of the additional layers are added until the surface is built up to a desired thickness.

Turning to FIG. 1, an apparatus 30 is shown which is used for storing particulate rubber and for mechanically pumping the particulate rubber from the storage location and broadcasting the rubber through a dispensing hose. The apparatus includes a storage bin or container 32 which is adapted for mounting on a vehicle 12 such as a pick-up. A conveying system is provided in the bottom of the storage bin and includes a conventional conveyor driven by hydraulic or other known motorized drive means 34.

The conveying system moves material within the bin to a chute 36 located at the rear of the bin and the material falls into a blower assembly 38 mounted on the rear end of the vehicle. The blower assembly includes a motor and an impeller which is driven by the motor and which forces the material entering the assembly to be driven through a dispensing hose 40.

Preferably, the conveying system includes variable speed drive control and the chute includes a gate which permits control of the flow of material into the blower assembly. The motor of the blower assembly is preferably a 16–20 horse power engine, and the assembly may be adapted from a conventional street cleaner blower system such as that marketed by Schwarze Industries, Inc.. By combining a blower assembly 38 of this type with a hose 40 having a diameter of about 4 inches, material from the bin 32 is driven through the hose 40 at a rate sufficient to permit the material to fall from an outlet 42 of the hose at a relatively low velocity but in high volume so that the direction of material exiting the hose may be easily controlled by an operator.

In order to assist in directing the flow of the material, a hose extension piece 44 may be used which is formed of a rigid material such as PVC, and which is of a length sufficient to permit accurate placement of the material falling from the hose in any desired region of the surface being covered. Further, it is possible to provide additional extension pieces which may be connected together in order to provide a hose extension piece of any desired length.

In operation, material within the bin 32 is moved toward the chute 36 by the conveyor system and enters the blower assembly 38 through the chute. Thereafter, the material is fluidized by the pumping action of the blower assembly and is driven through the hose 40 to the outlet 42 of the hose extension piece 44 and falls from the outlet onto the surface being covered. The rate of material flow is adjusted to provide a desired outlet volume and the extension piece is manipulated by an operator so as to broadcast the material to the desired region.

Although the invention has been described with reference to the preferred embodiment illustrated in the drawing figures, it is noted that substitutions may be made and equivalents employed herein without departing from the scope of the invention as recited in the following claims. For example, although in the embodiment shown, five layers of binder mixture and one layer of primer mixture are used, it is possible to follow the method of the present invention in applying various other combinations of layers.

What is claimed is:

1. A method of applying a latex-bound particulate rubber outdoor surface comprising the steps of:

providing a prepared base onto which the surface is to be applied;

applying a primer layer to the base, the primer layer being composed of a primer mixture including asphalt emulsion and water such that the layer is wet when applied and dries as the water separates from the mixture and evaporates;

directing a fluidized stream of particulate rubber onto the primer layer immediately after application of the primer layer before the primer layer begins to break so that a layer of particulate rubber settles into the primer layer;

applying a binder layer over the particulate rubber after the primer layer dries, the binder layer being composed of a mixture including latex and water such that the layer is wet when applied and dries as the water separates from the mixture and evaporates;

direction a fluidized stream of particulate rubber onto the binder layer immediately after application of the binder layer before the binder layer begins to break so that a layer of particulate rubber settles into the binder layer;

applying an additional binder layer over the layer of particulate rubber after the binder layer immediately beneath the layer of particulate rubber dries; and repeating the steps of directing a fluidized stream of particulate rubber onto an underlying wet binder layer and of applying an additional binder layer over the particulate rubber upon drying of the binder layer immediately beneath the particulate rubber, until the surface is built-up to a desired thickness, the steps of directing a fluidized stream of particulate rubber onto the primer and binder layers before the underlying exposed layer begins to break including mechanically pumping particulate rubber from a storage location and broadcasting the rubber onto the underlying exposed layer with the assistance of manual directing means for directing the flow of the particulate rubber.

2. The method as recited in claim 1, wherein the primer layer is sprayed onto the prepared base at a rate of about 0.4 gallons of primer mixture per square yard.

3. The method as recited in claim 1, wherein the particulate rubber is stranded waste tire buffings.

4. The method as recited in claim 1, wherein each layer of particulate rubber is applied at a rate of about 1.5 to 2.0 pounds per square yard.

5. The method as recited in claim 1, wherein the first binder mixture includes latex and an asphalt emulsion.

6. The method as recited in claim 1, further comprising the step of applying a sheen layer to the surface after application of the final binder layer, the sheen layer being composed of a mixture including a latex binder and water.

7. A method of applying a latex-bound particulate rubber outdoor surface comprising the steps of:

providing a prepared base onto which the surface is to be applied;

applying a primer layer to the base;

mechanically broadcasting and manually directing a fluidized stream of particulate rubber onto the primer layer immediately after application of the primer layer while the primer layer is liquid enough to permit a layer of the particulate rubber to settle into the primer layer;

applying a binder layer over the particulate rubber after the primer layer dries, the binder layer being composed of a mixture including latex and water such that the layer is wet when applied and dries as the water separates from the mixture and evaporates;

mechanically broadcasting and manually directing a fluidized stream of particulate rubber onto the binder layer immediately after application of the binder layer while the binder layer is liquid enough to permit a layer of particulate rubber to settle into the binder layer;

applying an additional binder layer over the layer of particulate rubber after the binder layer immediately beneath the layer of particulate rubber dries; and repeating the steps of mechanically broadcasting and manually directing a fluidized stream of particulate rubber onto an underlying wet binder layer and of applying an additional binder layer over the particulate rubber upon drying of the binder layer immediately beneath the particulate rubber, until the surface is built-up to a desired thickness.

* * * * *